US012618588B2

(12) United States Patent
Shaffer

(10) Patent No.: US 12,618,588 B2
(45) Date of Patent: May 5, 2026

(54) ENERGY RECOVERY VENTILATOR OF AN AIR CONDITIONING APPLIANCE

(71) Applicant: Haier US Appliance Solutions, Inc., Wilmington, DE (US)

(72) Inventor: Timothy Scott Shaffer, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 62 days.

(21) Appl. No.: 18/440,377

(22) Filed: Feb. 13, 2024

(65) Prior Publication Data

US 2025/0257900 A1 Aug. 14, 2025

(51) Int. Cl.

| | |
|---|---|
| ***F24F 13/30*** | (2006.01) |
| ***F24F 11/77*** | (2018.01) |
| ***F24F 12/00*** | (2006.01) |
| ***F24F 13/28*** | (2006.01) |

(52) U.S. Cl.

CPC ..... *F24F 13/30* (2013.01); *F24F 11/77* (2018.01); *F24F 12/006* (2013.01); *F24F 13/28* (2013.01)

(58) Field of Classification Search

CPC ..... F24F 1/0038; F24F 13/30; F24F 12/006; Y02B 30/56

See application file for complete search history.

(56) References Cited

U.S. PATENT DOCUMENTS

| | | | | |
|---|---|---|---|---|
| 5,855,320 | A * | 1/1999 | Grinbergs | F24F 12/006 237/50 |
| 11,187,429 | B2 | 11/2021 | Puttagunta et al. | |
| 11,713,901 | B2 | 8/2023 | Shaffer et al. | |
| 2012/0312035 | A1* | 12/2012 | Boucher | F24F 1/022 62/99 |
| 2013/0017774 | A1* | 1/2013 | Zorzit | F24F 1/0059 454/239 |
| 2019/0063780 | A1* | 2/2019 | Puttagunta | F24F 12/006 |
| 2019/0316807 | A1* | 10/2019 | Singh | F24F 13/20 |
| 2021/0199313 | A1* | 7/2021 | Chen | F24F 12/006 |
| 2021/0404671 | A1* | 12/2021 | Shaffer | F24F 1/0373 |
| 2022/0390140 | A1* | 12/2022 | Shaffer | F24F 1/022 |
| 2023/0059931 | A1* | 2/2023 | Tobbe | F24F 11/0001 |
| 2023/0349564 | A1* | 11/2023 | Ewing | F24F 1/027 |
| 2024/0035688 | A1* | 2/2024 | Park | F24F 7/08 |
| 2024/0060661 | A1* | 2/2024 | Park | F24F 1/029 |
| 2024/0060677 | A1* | 2/2024 | Park | F24F 11/74 |
| 2025/0020347 | A1* | 1/2025 | Shaffer | F24F 7/007 |
| 2025/0035336 | A1* | 1/2025 | Eicher | F24F 13/30 |

FOREIGN PATENT DOCUMENTS

| | | | | |
|---|---|---|---|---|
| CN | 207501384 U | | 6/2018 | |
| JP | 07233972 A | * | 9/1995 | F24F 12/006 |
| KR | 100834501 B1 | | 6/2008 | |

* cited by examiner

*Primary Examiner* — Nelson J Nieves
(74) *Attorney, Agent, or Firm* — Dority & Manning, P.A.

(57) ABSTRACT

An energy recovery ventilator for an air conditioner unit includes a ventilator cabinet defining a primary flow path and an energy recovery path, a heat exchanger positioned within the ventilator cabinet, wherein the primary flow path and the energy recovery path are fluidly isolated and thermally coupled within the heat exchanger; a primary fan fluidly coupled to the primary flow path for urging a flow of make-up air into an indoor portion of the air conditioner unit, and an auxiliary fan fluidly coupled to the energy recovery path for drawing a flow exhaust air through the energy recovery path.

20 Claims, 10 Drawing Sheets

ENERGY RECOVERY VENTILATOR OF AN AIR CONDITIONING APPLIANCE

FIELD OF THE INVENTION

The present subject matter relates generally to air conditioning appliances, and more particularly to features for energy recovery in air conditioning appliances.

BACKGROUND OF THE INVENTION

Air conditioner or conditioning units are conventionally utilized to adjust the temperature indoors, e.g., within structures such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed indoors that is connected to another portion located outdoors, e.g., by tubing or conduit carrying refrigerant. These types of units are typically used for conditioning the air in larger spaces.

Another type of air conditioner unit, commonly referred to as single-package vertical units (SPVU) or package terminal air conditioners (PTAC), may be utilized to adjust the temperature in, for example, a single room or group of rooms of a structure. These units typically operate like split heat pump systems, except that the indoor and outdoor portions are defined by a bulkhead and all system components are housed within a single package that is installed in a wall sleeve positioned within an opening of an exterior wall of a building. In this regard, such units commonly include an indoor portion that communicates (e.g., exchanges air) with the area within a building and an outdoor portion that generally communicates (e.g., exchanges air) with the area outside a building. Accordingly, the air conditioner unit generally extends through, for example, an outer wall of the structure, or is otherwise ducted to the outdoors.

SPVUs often need to draw air from the outdoor portion into the indoor portion. Accordingly, certain SPVUs allow for the introduction of make-up air into the indoor space, e.g., through a make-up air plenum or duct that extends between the indoor and outdoor side of the unit. The make-up air duct is usually equipped with a fan and/or make-up air module to urge a flow of make-up air from the outdoor side of the SPVU into the conditioned room. Notably, SPVUs that use a make-up air module for supplying make-up air from outdoors often suffer from inefficiencies. For example, the addition of outdoor make-up air adds a large amount of heating or cooling load to the space being conditioned.

Accordingly, an air conditioner unit with improved efficiency would be useful. More specifically, an SPVU that is capable of utilizing make-up air without excessive energy losses associated with the use of outdoor make-up air would be particularly beneficial.

BRIEF DESCRIPTION OF THE INVENTION

Aspects and advantages of the invention will be set forth in part in the following description, or may be obvious from the description, or may be learned through practice of the invention.

In one exemplary embodiment, an air conditioner unit defining a vertical, a lateral, and a transverse direction is provided. The air conditioner unit includes a cabinet defining an indoor inlet and an indoor outlet, a bulkhead mounted within the cabinet to define an indoor portion and an outdoor portion, and an energy recovery ventilator mounted to the cabinet. The energy recovery ventilator includes a ventilator cabinet defining a primary flow path and an energy recovery path, a heat exchanger positioned within the ventilator cabinet, wherein the primary flow path and the energy recovery path are fluidly isolated and thermally coupled within the heat exchanger, a primary fan fluidly coupled to the primary flow path for urging a flow of make-up air into the indoor portion, and an auxiliary fan fluidly coupled to the energy recovery path for drawing a flow exhaust air through the energy recovery path.

In another exemplary embodiment, an energy recovery ventilator for an air conditioner unit, the energy recovery ventilator including a ventilator cabinet defining a primary flow path and an energy recovery path, a heat exchanger positioned within the ventilator cabinet, wherein the primary flow path and the energy recovery path are fluidly isolated and thermally coupled within the heat exchanger, a primary fan fluidly coupled to the primary flow path for urging a flow of make-up air into an indoor portion of the air conditioner appliance, and an auxiliary fan fluidly coupled to the energy recovery path for drawing a flow exhaust air through the energy recovery path.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
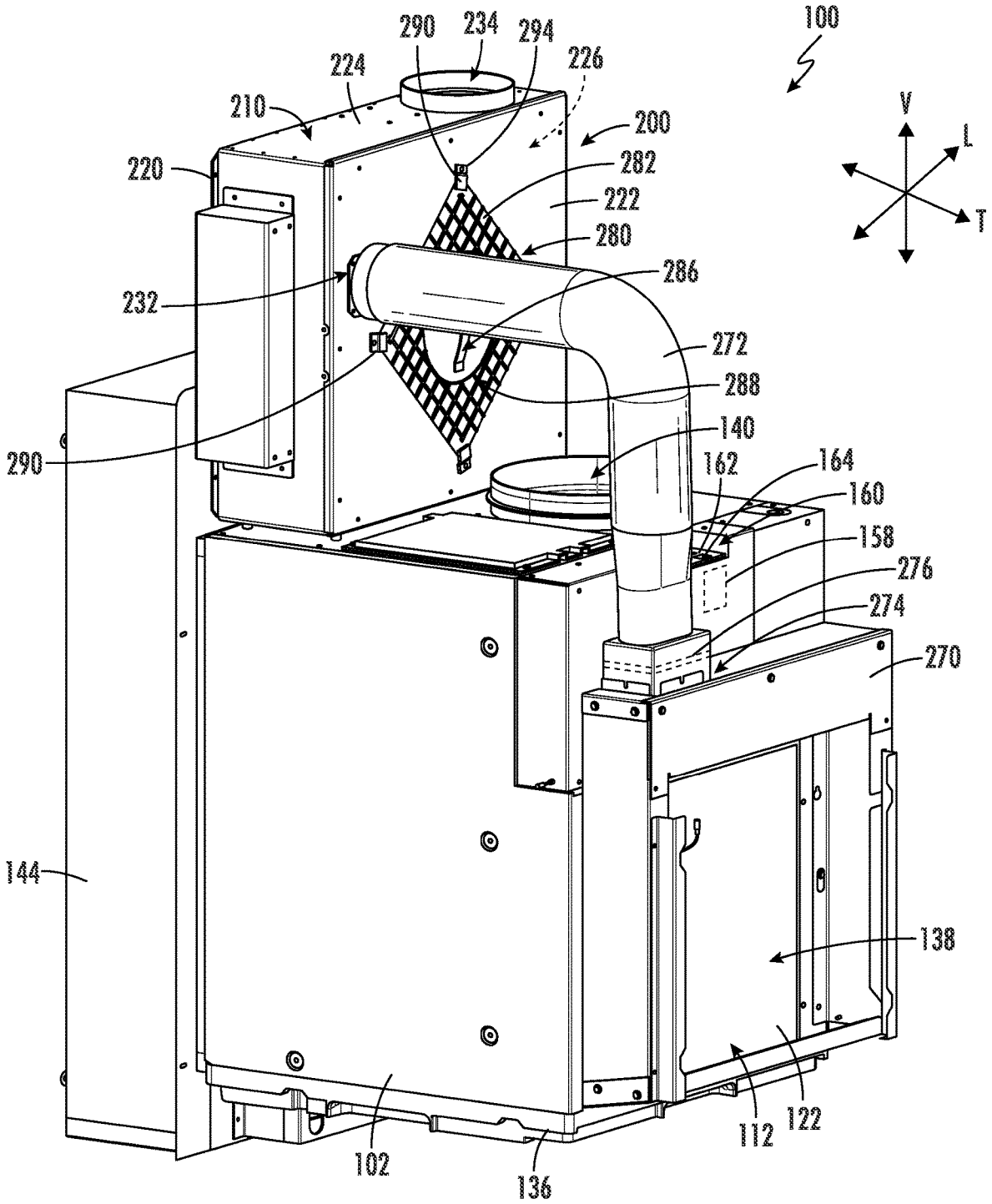
FIG. 1 provides a perspective view of an air conditioning appliance including an energy recovery ventilator according to an example embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
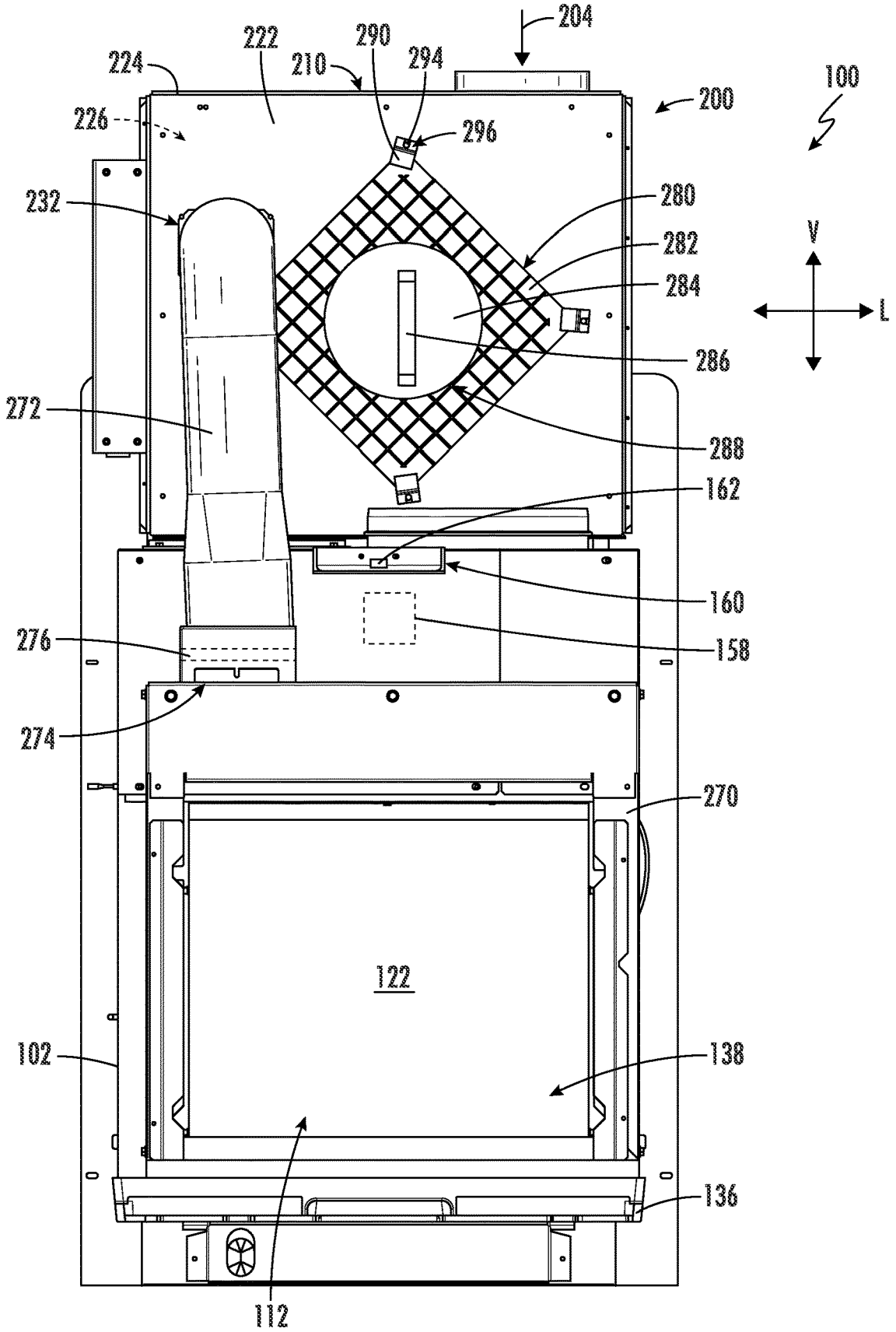
FIG. 2 provides a front view of the exemplary air conditioning appliance of FIG. 1 according to an example embodiment of the present subject matter.
Figure 3:
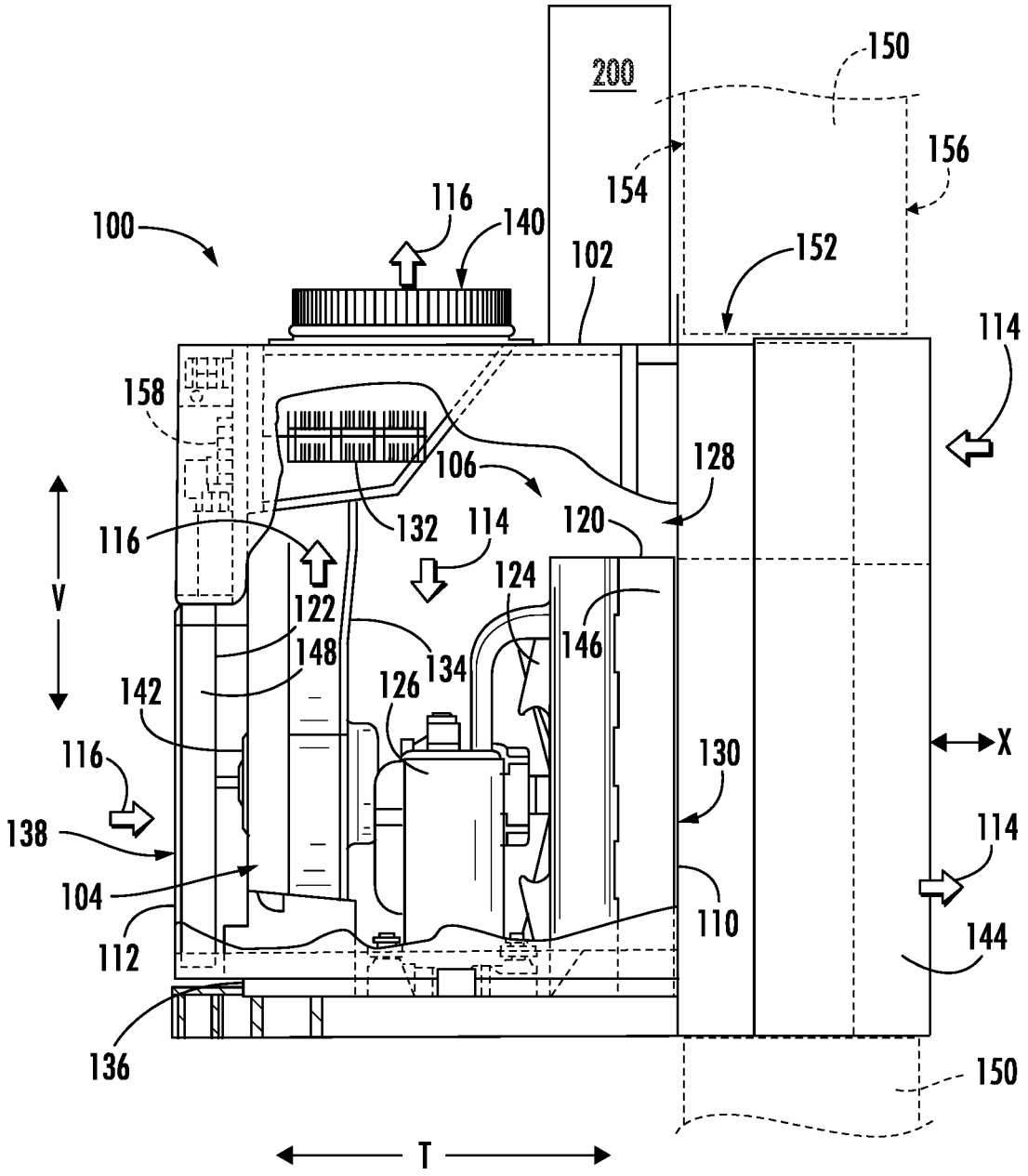
FIG. 3 provides a section view of the exemplary air conditioning appliance of FIG. 1 according to an example embodiment of the present subject matter.

Turning now to the figures, FIGS. 1 through 3 illustrate an exemplary air conditioner appliance (e.g., air conditioner 100). Specifically, FIG. 1 provides a perspective view of air conditioner 100, FIG. 2 provides a front view of air conditioner 100, and FIG. 3 provides a cross sectional view of air conditioner 100. As shown, air conditioner 100 may be provided as a one-unit type air conditioner 100, such as a single-package vertical unit (SPVU). However, it should be appreciated that aspects of the present subject matter may be used with other suitable air conditioning units or air filtering devices, such as a packaged terminal air conditioner unit (PTAC), a split heat pump system, etc.

Air conditioner 100 includes a package housing or cabinet 102 supporting and defining an indoor portion 104 and an outdoor portion 106. Generally, air conditioner 100 generally defines a vertical direction V, a lateral direction L, and a transverse direction T. Each direction V, L, T is perpendicular to each other, such that an orthogonal coordinate system is generally defined.

In some embodiments, cabinet 102 contains various other components of the air conditioner 100. Cabinet 102 may include, for example, a rear opening 110 (e.g., with or without a grill or grate thereacross) and a front opening 112 (e.g., with or without a grill or grate thereacross) may be spaced apart from each other along the transverse direction T. The rear opening 110 may be part of the outdoor portion 106, while the front opening 112 is part of the indoor portion 104. Components of the outdoor portion 106, such as an outdoor heat exchanger 120, outdoor fan 124, and compressor 126 may be enclosed within cabinet 102 between front opening 112 and rear opening 110. In certain embodiments, one or more components of outdoor portion 106 are mounted on a base pan 136, as shown. According to exemplary embodiments, base pan 136 may be received within a drain pan, e.g., for collecting condensation formed during operation.

During certain operations, air 114 may be drawn to outdoor portion 106 through rear opening 110. Specifically, an outdoor inlet 128 defined through cabinet 102 may receive outdoor air 114 motivated by outdoor fan 124. Within cabinet 102, the received outdoor air 114 may be motivated through or across outdoor fan 124. Moreover, at least a portion of the outdoor air 114 may be motivated through or across outdoor heat exchanger 120 before exiting the rear opening 110 at an outdoor outlet 130. It is noted that although outdoor inlet 128 is illustrated as being defined above outdoor outlet 130, alternative embodiments may reverse this relative orientation (e.g., such that outdoor inlet 128 is defined below outdoor outlet 130) or provide outdoor inlet 128 beside outdoor outlet 130 in a side-by-side orientation, or another suitable orientation.

As shown, indoor portion 104 may include an indoor heat exchanger 122, a blower fan 142, and a heating unit 132. These components may, for example, be housed behind the front opening 112. A bulkhead 134 may generally support or house various other components or portions thereof of the indoor portion 104, such as the blower fan 142. Bulkhead 134 may generally separate and define the indoor portion 104 and outdoor portion 106 within cabinet 102. Additionally, or alternatively, bulkhead 134 or indoor heat exchanger 122 may be mounted on base pan 136 (e.g., at a higher vertical position than outdoor heat exchanger 120), as shown.

During certain operations, air 116 may be drawn to indoor portion 104 through front opening 112. Specifically, an indoor inlet 138 defined through cabinet 102 may receive indoor air 116 motivated by blower fan 142. At least a portion of the indoor air 116 may be motivated through or across indoor heat exchanger 122 (e.g., before passing to bulkhead 134). From blower fan 142, indoor air 116 may be motivated (e.g., across heating unit 132) and returned to the indoor area of the room through an indoor outlet 140 defined through cabinet 102 (e.g., above indoor inlet 138 along the vertical direction V). Optionally, one or more conduits (not pictured) may be mounted on or downstream from indoor outlet 140 to further guide air 116 from air conditioner 100. It is noted that although indoor outlet 140 is illustrated as generally directing air upward, it is understood that indoor outlet 140 may be defined in alternative embodiments to direct air in any other suitable direction.

Outdoor and indoor heat exchanger 120, 122 may be components of a thermodynamic assembly (i.e., sealed system), which may be operated as a refrigeration assembly (and thus perform a refrigeration cycle) or, in the case of the heat pump unit embodiment, a heat pump (and thus perform a heat pump cycle). Thus, as is understood, exemplary heat pump unit embodiments may be selectively operated perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode).

The sealed system may, for example, further include compressor 126 (e.g., mounted on base pan 136) and an expansion device (e.g., expansion valve or capillary tube—not pictured), both of which may be in fluid communication with the heat exchangers 120, 122 to flow refrigerant therethrough, as is generally understood. The outdoor and indoor heat exchanger 120, 122 may each include coils 146, 148, as illustrated, through which a refrigerant may flow for heat exchange purposes, as is generally understood.

According to an example embodiment, compressor 126 may be a variable speed compressor. In this regard, compressor 126 may be operated at various speeds depending on the current air conditioning needs of the room and the demand on the sealed system. For example, according to an exemplary embodiment, compressor 126 may be configured to operate at any speed between a minimum speed, e.g., 1500 revolutions per minute (RPM), to a maximum rated speed, e.g., 3500 RPM. Notably, the use of variable speed compressor 126 enables efficient operation of the sealed system, minimizes unnecessary noise when compressor 126 does not need to operate at full speed, and ensures a comfortable environment within the room.

According to exemplary embodiments, air conditioner 100 may further include a plenum 144 to direct air to or from cabinet 102. When installed, plenum 144 may be selectively attached to (e.g., fixed to or mounted against) cabinet 102 (e.g., via a suitable mechanical fastener, adhesive, gasket, etc.) and extend through a structure wall 150 (e.g., an outer wall of the structure within which air conditioner 100 is installed) and above a floor of the structure. In particular, plenum 144 extends along an axial direction X (e.g., parallel to the transverse direction T) through a hole or channel 152 in the structure wall 150 that passes from an internal surface 154 to an external surface 156. In addition, it should be appreciated that plenum 144 may be formed from two or more telescoping structures, e.g., to accommodate different thicknesses of structure wall 150.

The operation of air conditioner 100 including compressor 126 (and thus the sealed system generally), blower fan 142, outdoor fan 124, heating unit 132, and other suitable components may be controlled by a control board or controller 158. Controller 158 may be in communication (via for example a suitable wired or wireless connection) to such components of the air conditioner 100. By way of example, the controller 158 may include a memory and one or more processing devices such as microprocessors, CPUs or the like, such as general or special purpose microprocessors operable to execute programming instructions or micro-control code associated with operation of air conditioner 100. The memory may be a separate component from the processor or may be included onboard within the processor. The memory may represent random access memory such as DRAM, or read only memory such as ROM or FLASH.

Air conditioner 100 may additionally include a control panel 160 and one or more user inputs 162, which may be included in control panel 160. The user inputs 162 may be in communication with the controller 158. A user of the air conditioner 100 may interact with the user inputs 162 to operate the air conditioner 100, and user commands may be transmitted between the user inputs 162 and controller 158 to facilitate operation of the air conditioner 100 based on such user commands. A display 164 may additionally be provided in control panel 160 and may be in communication with the controller 158. Display 164 may, for example be a touchscreen or other text-readable display screen, or alternatively may simply be a light that can be activated and deactivated as required to provide an indication of, for example, an event or setting for the air conditioner 100.

As explained briefly above, it may be desirable to periodically supplement the indoor air with make-up air from the outdoors. For example, in some cases it may be desirable to allow outside air (i.e., "make-up air") to flow into the room, e.g., in order to meet government regulations, to compensate for negative pressure created within the room, etc. In addition, it may be desirable to treat or condition make-up air prior to blowing it into the room, e.g., when there is a relatively large difference between the outdoor air temperature or humidity relative to target indoor temperature or humidity levels. For example, if it is very cold outside, it may be desirable to heat the flow of make-up air prior to passing it into the room, e.g., for improved occupant comfort and improved system efficiency. Accordingly, aspects of the present subject matter are generally directed to features of air conditioner 100 that may facilitate the supply of conditioned make-up air into the room.

Referring now generally to FIGS. 1 through 10, air conditioner 100 may generally include an energy recovery ventilator 200 that is generally configured for supplying a flow of make-up air (e.g., identified herein generally by reference numeral 202) into indoor portion 104, e.g., for mixing with a flow of indoor air 116. In addition, energy recovery ventilator 200 may be configured for collecting a flow of exhaust air (e.g., identified herein generally by reference numeral 204) and transferring thermal energy between the flow of make-up air 202 and the flow of exhaust air 204. Energy recovery ventilator 200 will be described in more detail below according to an example embodiment. However, it should be appreciated that the embodiment described as only exemplary and is not intended to limit the scope of the present subject matter in any manner.

According to the illustrated embodiment, energy recovery ventilator 200 may generally be mounted or fixed to cabinet 102 of air conditioner 100. Specifically, according to the illustrated embodiment, energy recovery ventilator 200 is positioned on top of cabinet 102, though other suitable positions are possible and within the scope of the present subject matter. According to an example embodiment, energy recovery ventilator 200 generally includes a ventilator cabinet 210 through which the flow of make-up air 202 and the flow of exhaust air 204 are passed. Specifically, ventilator cabinet 210 may generally define a primary flow path 212 through which the flow of make-up air 202 passes and an energy recovery path 214 through which the flow of exhaust air 204 passes.

Although energy recovery ventilator 200 and ventilator cabinet 210 are described herein as being used with air conditioner unit 100 and being mounted directly thereon, it should be appreciated that energy recovery ventilator 200 and ventilator cabinet 210 may be used with any suitable air conditioner/heat pump system. Furthermore, any suitable positioning of the ventilator cabinet 210 is possible (e.g., remote from air conditioner unit) and any suitable routing or ducting of the primary flow path 212 and the energy recovery path 214 are possible and within the scope of the present subject matter.

Specifically, according to the illustrated embodiment, ventilator cabinet 210 may generally include a rear wall 220, the front wall 222, and a plurality of sidewalls 224 that generally define a square or rectangular box that defines a ventilator plenum 226. Notably, according to an example embodiment, in order to retain thermal energy within the ventilator cabinet 210, ventilator cabinet 210 may generally be an insulated housing, e.g., such that the interior surfaces of ventilator cabinet 210 may be covered in an insulating material, may be formed from insulative layers, or may otherwise be suitably thermally insulated.

Figure 7:
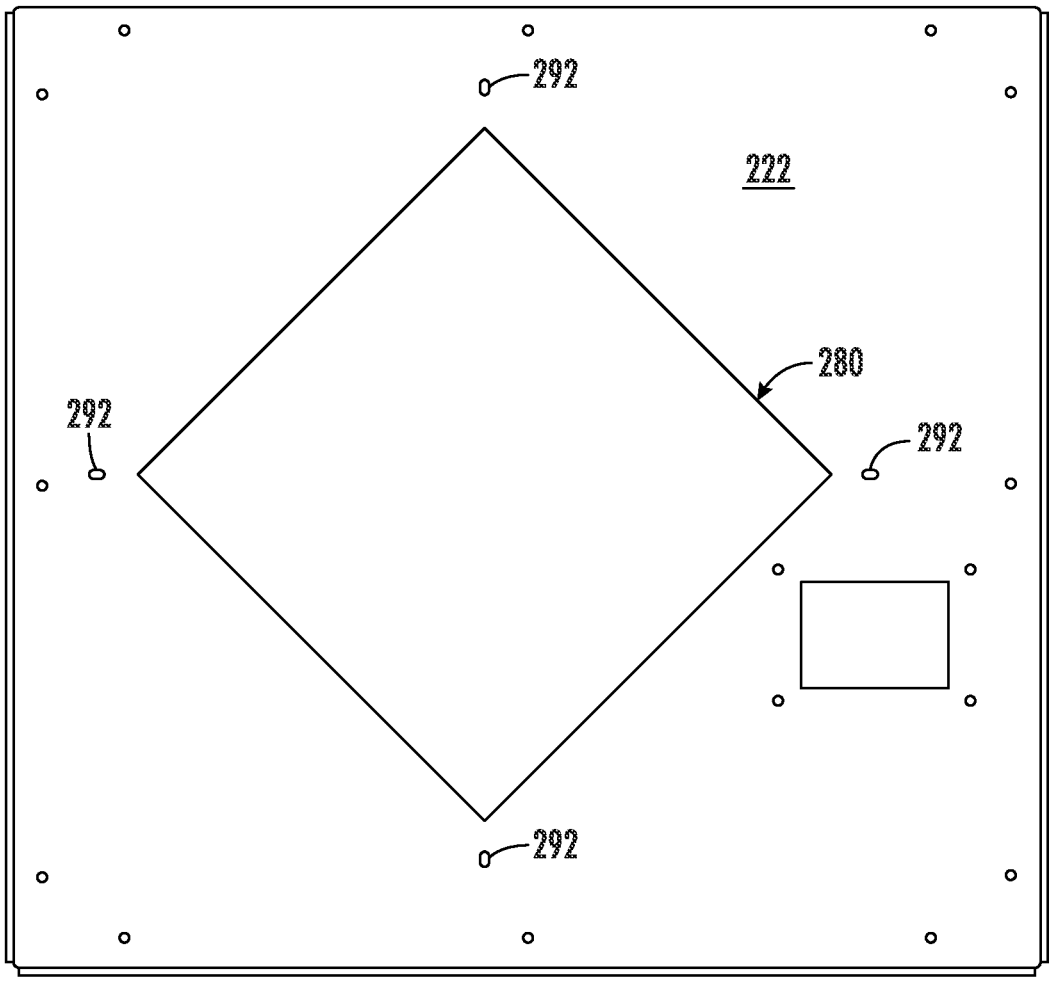
FIG. 7 provides a perspective view of the front cover of the example energy recovery ventilator of FIG. 1 according to an exemplary embodiment of the present subject matter.
Figure 8:
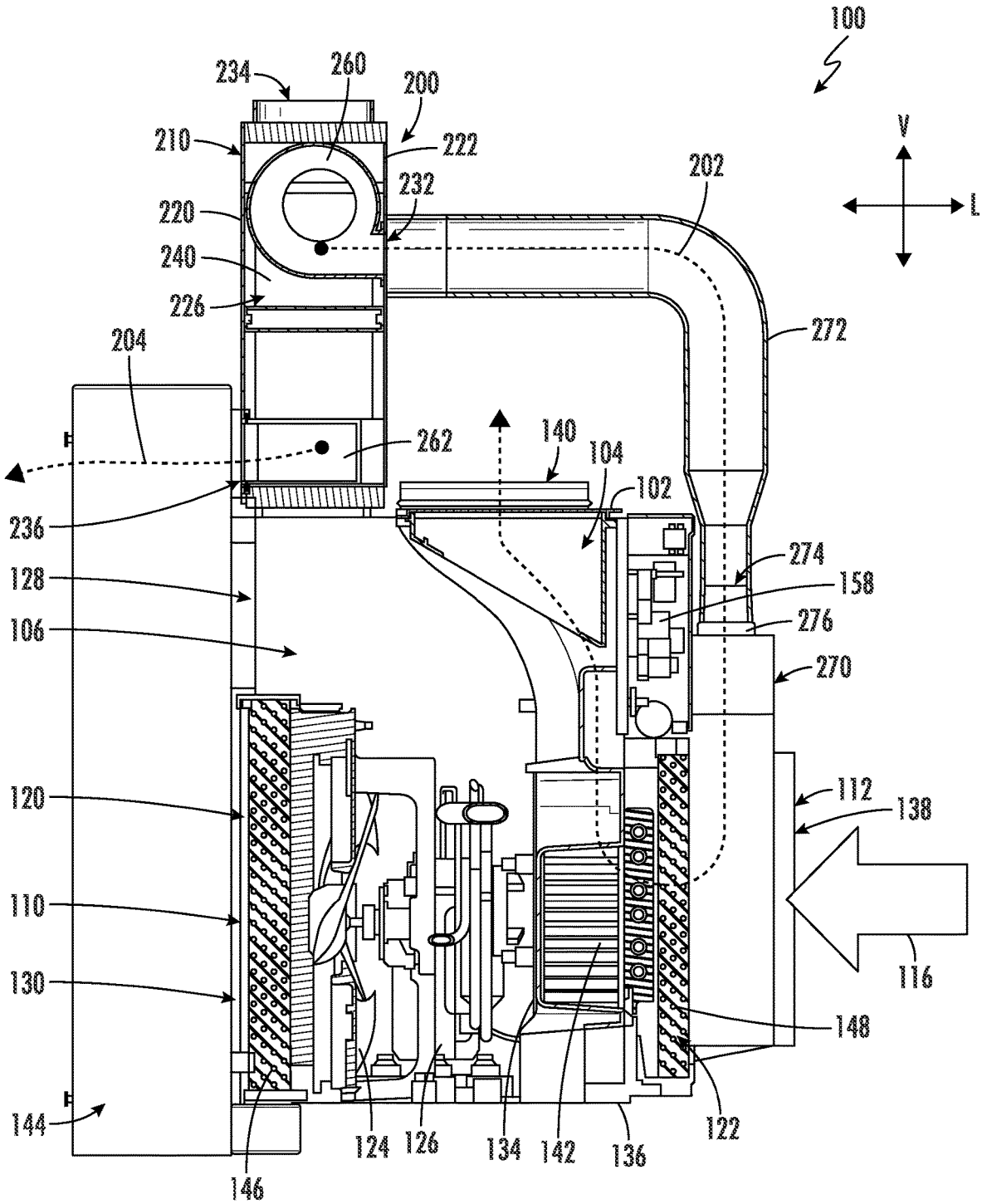
FIG. 8 provides a side, cross-sectional view of the example air conditioner unit and energy recovery ventilator of FIG. 1 according to an exemplary embodiment of the present subject matter.
Figure 9:
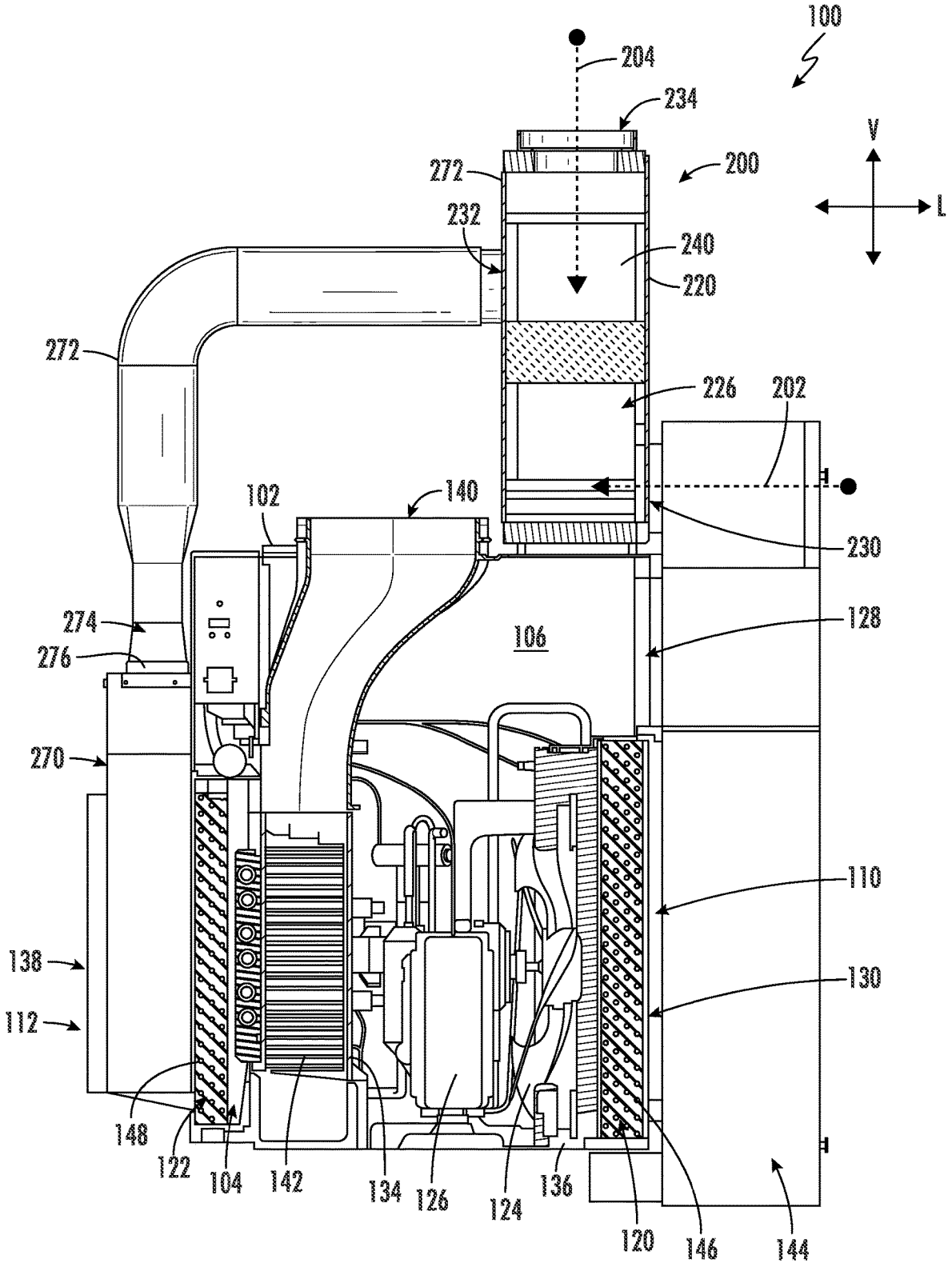
FIG. 9 provides another side, cross-sectional view of the example air conditioner unit and energy recovery ventilator of FIG. 1 according to an exemplary embodiment of the present subject matter.
Figure 10:
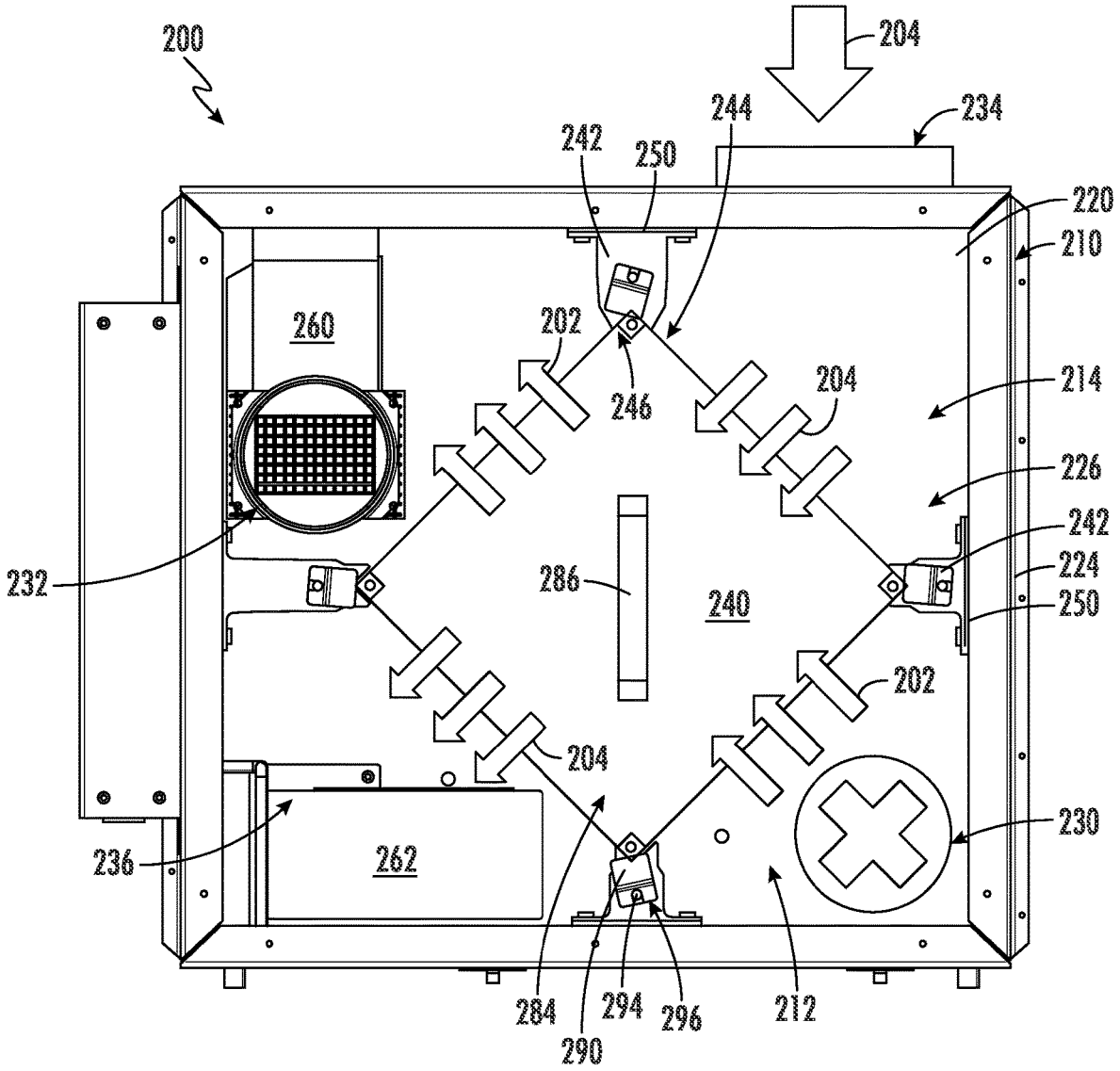
FIG. 10 provides a front view of the example energy recovery ventilator of FIG. 1 according to an example embodiment of the present subject matter.

Referring now specifically to FIGS. 4 through 10, ventilator cabinet 210 may generally define a fresh air inlet 230 that is fluidly coupled to an ambient environment (e.g., the outdoors). In this manner, air conditioner 100 may draw in the flow of make-up air 202 from outside of the building where air conditioner 100 is located and may pass the flow of make-up air 202 through ventilator plenum 226. In addition, ventilator cabinet 210 may define a fresh air outlet 232 that is fluidly coupled to the indoor portion 104 of air conditioner 100. As best shown in FIGS. 8 through 10, fresh air inlet 230 and fresh air outlet 232 generally form a portion of primary flow path 212.

In addition, ventilator cabinet 210 may generally define an exhaust inlet 234 that is fluidly coupled to an interior space where air conditioner 100 is located. In this regard, for example, exhaust inlet 234 may be fluidly coupled to a return air duct system from an indoor space that is conditioned by air conditioner 100. For example, this return air duct system may collect indoor air from a connected bathroom, multiple rooms of a suite, or other areas within the indoor space. Ventilator cabinet 210 may further define an exhaust outlet 236 that is fluidly coupled to the ambient environment (e.g., the outdoors). Exhaust inlet 234 and exhaust outlet 236 may generally form a portion of energy recovery path 214.

Notably, as described briefly above, the flow of make-up air 202 from outdoor portion 106 may have a temperature that would be uncomfortable if directed into the indoor portion 104 without being conditioned. For example, if it is very cold outside, the flow of make-up air 202 may be cool or frigid, and injecting such air into the flow of indoor air 116 may result in poor system efficiency and user dissatisfaction. By contrast, if it is very warm outside, it may be desirable to lower the temperature of the flow of make-up air 202 before injecting it into the room.

Accordingly, energy recover ventilator 200 may further include a heat exchanger 240 that is positioned within ventilator plenum 226 for transferring thermal energy to or from the flow of make-up air 202 such that the temperature of the flow of make-up air 202 is more desirable and appropriate to the conditioning needs of the room. Specifically, according to the illustrated embodiment, heat exchanger 240 may generally define a portion of primary flow path 212 through which the flow of make-up air 202 passes into the room. In addition, heat exchanger 240 may define a portion of energy recovery path 214. As explained herein, energy recovery path 214 may generally be configured for receiving the flow of exhaust air 204 that is configured for transferring heat with the flow of make-up air 202, e.g., via heat exchanger 240.

More specifically, according to example embodiments, primary flow path 212 and energy recovery path 214 are fluidly isolated from each other while being thermally coupled to each other. For example, according to the illustrated embodiment, heat exchanger 240 is a crossflow air-to-air heat exchanger. In this regard, the flow of make-up air 202 and the flow of exhaust air 204 may flow through fluidly isolated passages perpendicular to each other such that thermal energy may pass between the two flows while they may remain fluidly isolated. For example, according to the illustrated embodiment, heat exchanger 240 comprises a plurality of thin plates stacked along the transverse direction T. These plates at least partially define primary flow path 212 and energy recovery path 214 and may be used to separate the two flows.

According to the illustrated embodiment, energy recovery ventilator 200 may generally include a plurality of retainer brackets that are positioned within ventilator plenum 226 and generally define a boundary of a heat exchanger cavity 244. For example, according to the illustrated embodiment, energy recovery ventilator 200 includes four retainer brackets 242 that are positioned on the four sidewalls 224 of ventilator cabinet 210. These retainer brackets 242 generally extend from sidewalls 224 into ventilator plenum 226 to sealingly engage respective corners of heat exchanger 240. More specifically, a distal end 246 of each of retainer brackets 242 may generally define a notch or V-shaped slot for receiving heat exchanger 240. In addition, it should be appreciated that distal ends 246 may include a sealing material or gasket (not shown) for preventing air leakage between retainer brackets 242 and heat exchanger 240.

In addition, energy recovery ventilator 200 may include a plurality of mounting gaskets 250 that are positioned between retainer brackets 242 and ventilator cabinet 210 to provide a fluid seal and to divide ventilator plenum 226 into four quadrants that are at least partially fluidly isolated from each other, e.g., thereby defining primary flow path 212 and energy recovery path 214. In operation, the flow of make-up air 202 may enter fresh air inlet 230 and may pass through heat exchanger 240 before exiting fresh air outlet 232 along the primary flow path 212. Similarly, the flow of exhaust air 204 may enter exhaust inlet 234 and may pass through heat exchanger 240 before exiting exhaust outlet 236 along the energy recovery path 214. Notably, the flow of make-up air 202 and the flow of exhaust air 204 may transfer thermal energy between each other in heat exchanger 240 while remaining fluidly isolated.

According to the illustrated embodiment, energy recover ventilator 200 may include one or more fan assemblies for selectively urging the flow of make-up air 202 and the flow of exhaust air 204. In this regard, as illustrated, energy recover ventilator 200 may generally include a primary fan 260 fluidly coupled to primary flow path 212 for urging the flow of make-up air 202 into indoor portion 104, e.g., via fresh air outlet 232. According to the illustrated embodiment, primary fan 260 may be positioned on a downstream end of heat exchanger 240. In addition, energy recover ventilator 200 may include an auxiliary fan 262 that is fluidly coupled to energy recovery path 214 for drawing a flow of exhaust air 204 through energy recovery path 214. According to the illustrated embodiment, auxiliary fan 262 may be positioned on the downstream end of heat exchanger 240. According to the illustrated embodiment, primary fan 260 and auxiliary fan 262 are positioned within ventilator cabinet 210, though other suitable positions are possible and within the scope of the present subject matter.

According to the illustrated embodiment, both primary fan 260 and auxiliary fan 262 are centrifugal fans. However, it should be appreciated that any other suitable number, type, and configuration of fan or blower could be used to urge a flow of make-up air 202 and the flow of exhaust air 204 according to alternative embodiments. In addition, primary fan 260 and auxiliary fan 262 may be positioned in any other suitable location within energy recover ventilator 200. The embodiments described herein are only exemplary and are not intended to limit the scope of the present subject matter.

As best shown in FIGS. 1, 2, 8, and 9, air-conditioner 100 may further define a standoff plenum 270 that at least partially define indoor inlet 138 of cabinet 102. In this regard, standoff plenum 270 may generally be positioned upstream of indoor heat exchanger 122 and may be configured to receive the flow of indoor air 116 and the flow of make-up air 202. In addition, air-conditioner 100 may further include a make-up air duct 272 that provides fluid communication with fresh air outlet 232 and a make-up air supply port 274 that is defined on standoff plenum 270. In this manner, the conditioned flow of make-up air 202 may exit energy recovery ventilator 200, pass through make-up air duct 272, and interior into standoff plenum 270 where it mixes with the flow of indoor air 116.

According to example embodiments, controller 158 of air conditioner 100 may be operably coupled to primary fan 260 and auxiliary fan 262 for regulating the flow of make-up air 202 and the flow of exhaust air 204, respectively. It should be appreciated that these fans may be operated at the same speed or at a different speed depending on ambient conditions in the room or outside conditions. For example, the flow rate of the flow of make-up air 202 is typically dictated by the make-up air needs within the room, e.g., based on government regulations, occupancy, bathroom fan operation, etc. Similarly, the outside temperature and humidity may require different flow rates of the flow of exhaust air 204 to suitably condition the flow of make-up air 202 prior to introduction into the room.

Thus, according to example embodiments, controller 158 may dynamically adjust the flow rates of each of the flow of make-up air 202 and the flow of exhaust air 204 depending on various atmospheric and operating conditions. According to an example embodiment, it may be desirable to operate the primary fan 260 and the auxiliary fan 262 at the same flow rate. In general, the target flow rate for the flow of make-up air 202 and the flow of exhaust air 204 may be between about 10 and 60 cubic feet per minute (cfm), between about 20 and 50 cfm, between about 30 and 40 cfm, or about 35 cfm.

In addition, it should be appreciated that primary fan 260, auxiliary fan 262, and blower fan 142 may be collectively operated in order to ensure that the flow of make-up air 202 is provided at a target flow rate while the outlet temperature of indoor air 116 remains within a desired range. For example, according to an example embodiment, these fans are operating to mix one part of the flow of make-up air 202 to every three parts of the flow of indoor air 116. Other suitable mix ratios are possible and within the scope of the present subject matter.

Notably, it may be desirable to periodically stop the flow of make-up air 202 and/or the flow of exhaust air 204. Accordingly, air conditioner 100 or energy recover ventilator 200 may further include one or more doors that are pivotable between an open and closed position to permit or restrict the respective flows of air. For example, vent doors (not shown) may be positioned in the energy recovery ventilator 200 or any other suitable location within air conditioner 100 for selectively restricting the flow of make-up air 202 and/or the flow of exhaust air 204.

Referring still to FIGS. 1, 2, 8, and 9, it may be desirable to filter the flow of make-up air 202 before introducing it into indoor portion 104. Accordingly, air conditioner 100 may further include a filter 276 that is positioned within primary flow path 212 for filtering the flow of make-up air 202. It should be appreciated that filter 276 may be any suitable type, position, and configuration of filtering mechanisms. For example, filter 276 may be a screen filter, a pleated filter, an electrostatic filter, a carbon filter, a fiber glass filter, or any other suitable type of filter. Although filter 276 is illustrated as being positioned within make-up air duct 272, e.g., at make-up air supply port 274, it should be appreciated that filter 276 may alternatively be positioned at any other suitable location within primary flow path 212.

Notably, it may be desirable to have access to heat exchanger 240, e.g., for periodic maintenance, to clear clogs, or to otherwise improve the operating efficiency of energy recovery ventilator 200. Accordingly, ventilator cabinet 210 may generally define an access opening 280 for providing access to heat exchanger cavity 244. Notably, it is desirable to maintain a good fluid seal between ventilator cabinet 210 and heat exchanger 240, e.g., to ensure a fluid isolation between primary flow path 212 and energy recovery path 214. Accordingly, heat exchanger 240 may define a tight or snug fit within heat exchanger cavity 244.

Specifically, according to an example embodiment, mounting gaskets 250 may be compressible such that retainer brackets 242 may move or flex slightly relative to sidewalls 224 of ventilator cabinet 210. In this manner, as a user is inserting heat exchanger 240 into heat exchanger cavity 244, retainer brackets 242 may be displaced to insert heat exchanger 240 while the resilient nature of mounting gaskets 250 rebound to form a strong seal with heat exchanger 240 when the retainer brackets 242 are no longer manually displaced.

Figure 4:
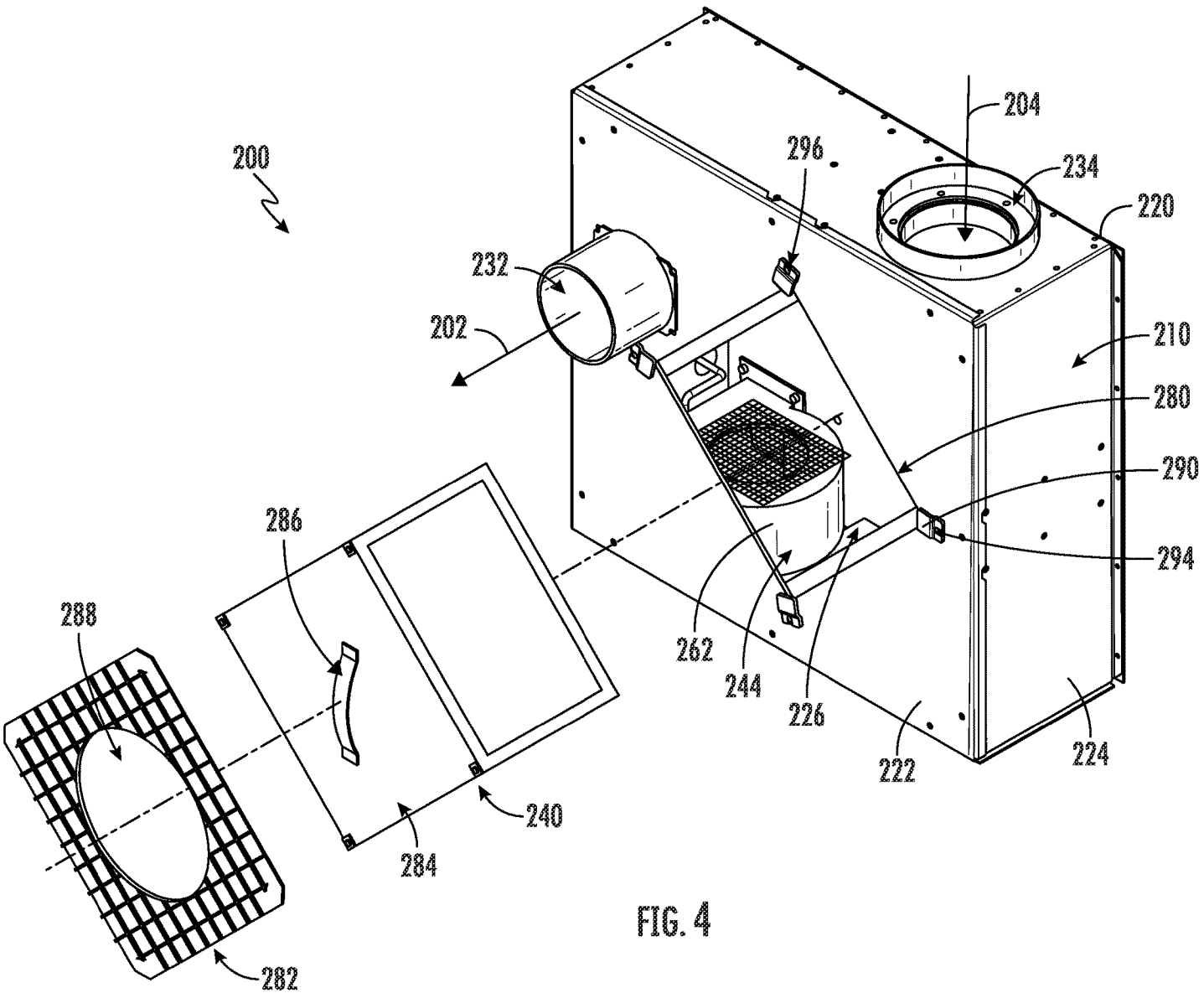
FIG. 4 provides an exploded view of the example energy recovery ventilator of FIG. 1 according to an exemplary embodiment of the present subject matter.
Figure 5:
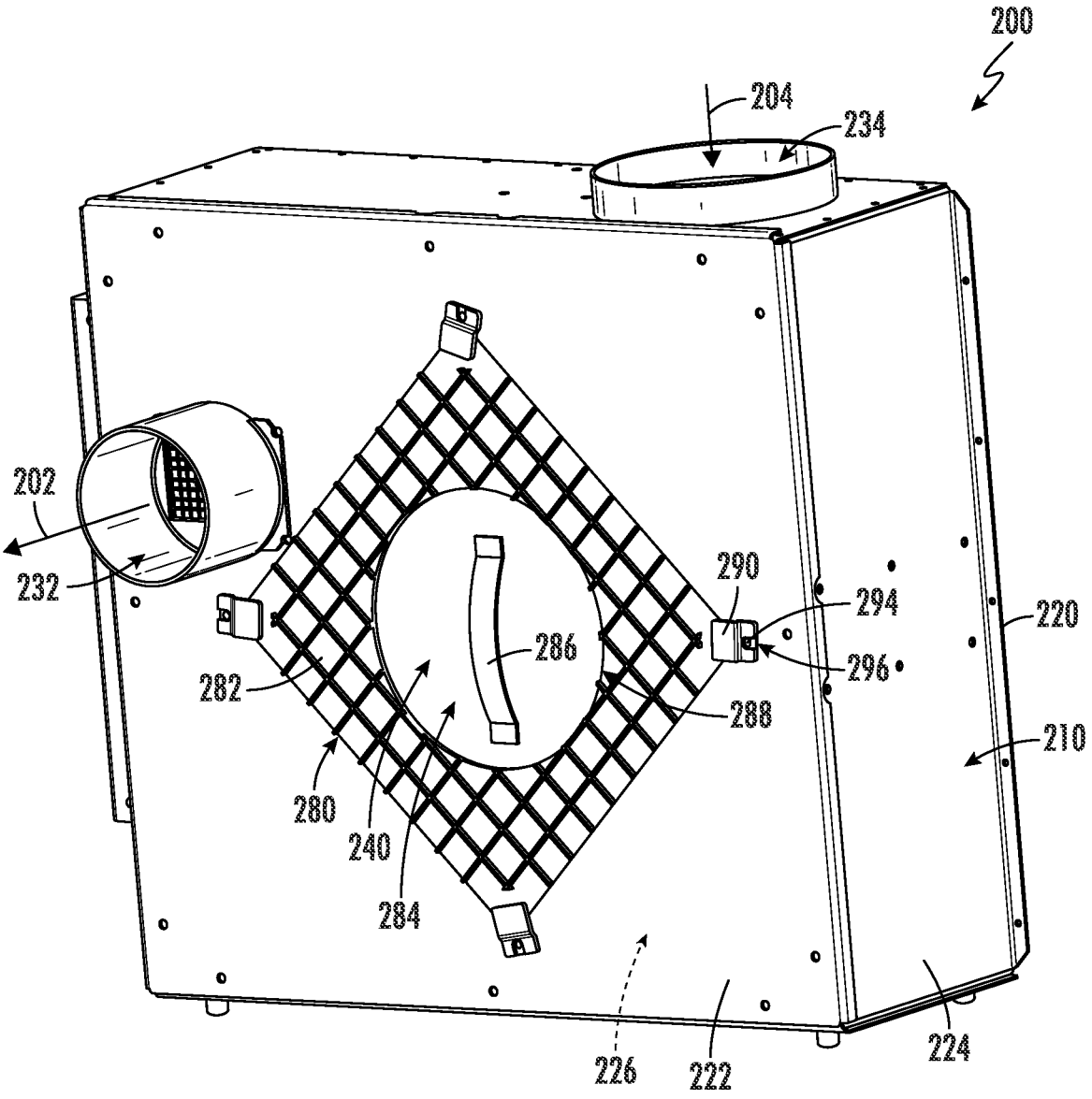
FIG. 5 provides a perspective view of the example energy recovery ventilator of FIG. 1 according to an exemplary embodiment of the present subject matter.
Figure 6:
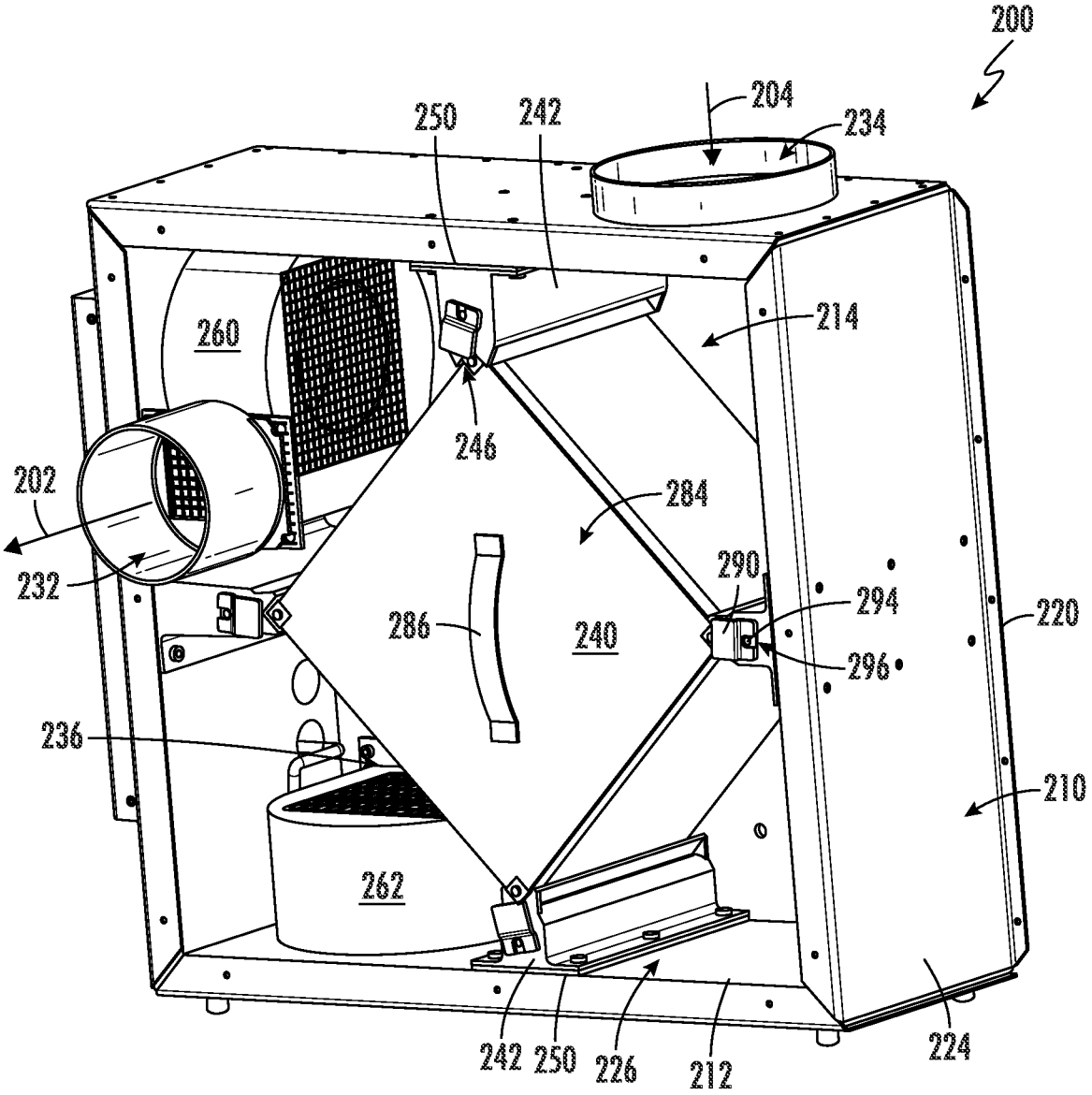
FIG. 6 provides a perspective view of the example energy recovery ventilator of FIG. 1 with a front cover removed according to an exemplary embodiment of the present subject matter.

As best shown in FIGS. 4 and 5, energy recovery ventilator 200 may further include an access cover 282 that is removably mounted over access opening 280 for providing selective access to heat exchanger cavity 244. Notably, due to the limited space available in locations where air conditioner 100 is typically installed, access cover 282 may be fully removable instead of being a hinged cover. It should be appreciated that a gasket (not shown) may be positioned or defined on an inner face of access cover 282, e.g., to form a fluid seal with a front 284 of heat exchanger 240. In addition, according to the illustrated embodiment, heat exchanger 240 includes a handle 286 that extends from front 284 and access cover 282 finds an aperture 288 for receiving the handle 286.

According to the illustrated embodiment, in order to secure access cover 282 over access opening 280, energy recovery ventilator 200 may further include a plurality of rotatable clips 290 that are positioned on an outside of ventilator cabinet 210. More specifically, according to an example embodiment, rotatable clips 290 may be rotatable and slidable relative to front wall 222 of ventilator cabinet 210. In this manner, rotatable clips 290 may be fully recessed or moved out of the way relative to access opening 280, e.g., to facilitate the insertion of heat exchanger 240 into a heat exchanger cavity 244. After heat exchanger 240 is properly installed, rotatable clips 290 may be rotated and slid to secure access cover 282 against front wall 222 of ventilator cabinet 210 and front 284 of heat exchanger 240.

Specifically, according to the illustrated embodiment, rotatable clips 290 are mounted directly to retainer brackets 242 such that movement of retainer brackets 242 (e.g., through compression of mounting gaskets 250) permit the rotatable clips 290 to be retracted relative to access opening 280 while springing back toward access opening 280 when released after heat exchanger 240 is installed. In this manner, rotatable clips 290 securely and sealingly engage access cover 282 over access opening 280. For example, the plurality of retainer brackets 242 and the plurality of rotatable clips 290 may be configured to slide between about 1/32 and 1/2 of an inch, between about 1/16 and 1/4 of an inch, or about 1/8 of an inch.

Notably, in order to permit the sliding of rotatable clips 290, front wall 222 of ventilator cabinet 210 may generally define an elongated slot 292 (e.g., as shown in FIG. 7). In addition, retainer brackets 242 may each define a stud 294 is configured for engaging a mounting aperture 296 of each respective rotatable clip 290, thereby rotatably coupling rotatable clips 290 to retainer brackets 242. As shown, elongated slots 292 permit the movement of retainer brackets 242 and rotatable clips 290 during installation of heat exchanger 240 (e.g., relative to fixed front wall 222 of ventilator cabinet 210). Although four retainer brackets 242 and rotatable clips 290 are illustrated, it should be appreciated that energy recovery ventilator 200 may include any other suitable number, type, position, and configuration of retaining brackets and rotatable clips.

As explained herein, aspects of the present subject matter are generally directed to a method of mixing fresh air (e.g., make-up air) in a vertical air conditioner. A ventilator kit with an air-to-air heat exchanger may be located atop the vertical air conditioner. Fresh air may be introduced via a duct into the ventilator kit on the lower right-hand side where air is then sucked into a cross flow plate exchanger with the unconditioned exhaust stream of the building moving perpendicular to the fresh air intake. Once passing through the crossflow plate (air to air) heat exchanger and exchanging sensible and latent energy with the exhaust stream, the conditioned fresh air stream may be collected in an insulated cavity on the upper left-hand side of the ventilator. A centrifugal fan may induce a vacuum within the upper left hand side cavity drawing air from the plate heat exchanger and pushing it out the front of the ventilator. A duct may then be connected between the upper left hand side cavity to the front stand-off plenum of the vertical air conditioner. The standoff plenum may direct the conditioned fresh air in front of the room recirculation path of the vertical air conditioner such that room air is mixed with the conditioned fresh air being provided by the ventilator.

In addition, aspects of the present subject matter are generally directed to a vertical air conditioner unit with an opening in front of the energy recovery ventilator (ERV) to access a plate heat exchanger. A removable access cover for the ERC may be used to facilitate easy, space conserving access to the plate heat exchanger, e.g., for servicing, replacement, cleaning, etc. For example, four rotatable clips may secure the detachable access cover onto the front cover and the air conditioner unit and pressurize the heat exchange chamber. The clips may attach to retainer brackets within the ERV to allow outward adjustment and some movement around the plate heat exchanger during installation, while returning to a tight seal between the retainers and the plate heat exchanger after adjustment.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit defining a vertical, a lateral, and a transverse direction, the air conditioner unit comprising:
- a cabinet defining an indoor inlet and an indoor outlet;
- a bulkhead mounted within the cabinet to define an indoor portion and an outdoor portion; and
- an energy recovery ventilator mounted to the cabinet, the energy recovery ventilator comprising:
  - a ventilator cabinet defining a primary flow path and an energy recovery path;
  - a heat exchanger positioned within the ventilator cabinet, wherein the primary flow path and the energy recovery path are fluidly isolated and thermally coupled within the heat exchanger;
  - a primary fan fluidly coupled to the primary flow path for urging a flow of make-up air into the indoor portion;
  - an auxiliary fan fluidly coupled to the energy recovery path for drawing a flow exhaust air through the energy recovery path;
  - a plurality of retainer brackets that define a boundary of the heat exchanger; and
  - a plurality of mounting gaskets positioned between the plurality of retainer brackets and a sidewall of the ventilator cabinet, wherein the heat exchanger is securely received within the plurality of retainer brackets in an installed position.

2. The air conditioner unit of claim 1, wherein the ventilator cabinet is positioned on top of the cabinet of the air conditioner unit.

3. The air conditioner unit of claim 1, wherein the primary fan and the auxiliary fan are positioned within the ventilator cabinet.

4. The air conditioner unit of claim 1, wherein the ventilator cabinet defines an exhaust inlet fluidly coupled to an interior space and an exhaust outlet fluidly coupled to an ambient environment, the exhaust inlet and the exhaust outlet forming a portion of the energy recovery path.

5. The air conditioner unit of claim 1, wherein the ventilator cabinet defines a fresh air inlet fluidly coupled to an ambient environment and a fresh air outlet fluidly coupled to the indoor portion, the fresh air inlet and the fresh air outlet forming a portion of the primary flow path.

6. The air conditioner unit of claim 5, further comprising:
- a standoff plenum that at least partially defines the indoor inlet of the cabinet; and
- a make-up air duct providing fluid communication between the fresh air outlet and a make-up air supply port defined on the standoff plenum.

7. The air conditioner unit of claim 6, wherein the standoff plenum is positioned upstream of an indoor heat exchanger such that the flow of make-up air mixes with a flow of indoor air.

8. The air conditioner unit of claim 7, wherein the primary fan and an indoor fan are operated to mix one part of the flow of make-up air to three parts of the flow of indoor air.

9. The air conditioner unit of claim 1, wherein the ventilator cabinet is an insulated housing.

10. The air conditioner unit of claim 1, further comprising:
- a filter positioned in the primary flow path for filtering the flow of make-up air.

11. The air conditioner unit of claim 1, further comprising:
- a controller operably coupled to the primary fan and the auxiliary fan, the controller being configured to operate the primary fan and the auxiliary fan at a target fan speed for generating a target flow rate.

12. The air conditioner unit of claim 11, wherein the target flow rate is between about 30 and 40 cubic feet per minute.

13. The air conditioner unit of claim 1, wherein the heat exchanger is a crossflow air-to-air heat exchanger.

14. The air conditioner unit of claim 1, wherein the air conditioner unit is a single package vertical unit, a vertical terminal air conditioner unit, or a packaged terminal air conditioner unit.

15. An energy recovery ventilator for an air conditioner unit, the energy recovery ventilator comprising:

a ventilator cabinet defining a primary flow path and an energy recovery path;

a heat exchanger positioned within the ventilator cabinet, wherein the primary flow path and the energy recovery path are fluidly isolated and thermally coupled within the heat exchanger;

a primary fan fluidly coupled to the primary flow path for urging a flow of make-up air into an indoor portion of the air conditioner appliance;

an auxiliary fan fluidly coupled to the energy recovery path for drawing a flow exhaust air through the energy recovery path;

a plurality of retainer brackets that define a boundary of the heat exchanger; and a plurality of mounting gaskets positioned between the plurality of retainer brackets and a sidewall of the ventilator cabinet, wherein the heat exchanger is securely received within the plurality of retainer brackets in an installed position.

16. The energy recovery ventilator of claim 15, wherein the ventilator cabinet is positioned on top of a cabinet of the air conditioner unit and the primary fan and the auxiliary fan are positioned within the ventilator cabinet.

17. The energy recovery ventilator of claim 15, wherein the ventilator cabinet defines an exhaust inlet fluidly coupled to an interior space and an exhaust outlet fluidly coupled to an ambient environment, the exhaust inlet and the exhaust outlet forming a portion of the energy recovery path.

18. The energy recovery ventilator of claim 15, wherein the ventilator cabinet defines a fresh air inlet fluidly coupled to an ambient environment and a fresh air outlet fluidly coupled to the indoor portion, the fresh air inlet and the fresh air outlet forming a portion of the primary flow path.

19. The energy recovery ventilator of claim 18, further comprising:

a standoff plenum that at least partially defines an indoor inlet of a cabinet of the air conditioner unit; and a make-up air duct providing fluid communication between the fresh air outlet and a make-up air supply port defined on the standoff plenum.

20. The energy recovery ventilator of claim 15, wherein the ventilator cabinet is an insulated housing.

* * * * *